United States Patent [19]

Kalendovsky

[11] 4,328,930

[45] May 11, 1982

[54] COMPOSITE REEL AND STAND FOR A SWIMMING POOL COVER

[76] Inventor: Jiri Kalendovsky, 7482 Crannall Dr., Boulder, Colo. 80303

[21] Appl. No.: 166,983

[22] Filed: Jul. 8, 1980

[51] Int. Cl.[3] ..... B65H 75/02

[52] U.S. Cl. ..... 242/55; 4/498; 403/171

[58] Field of Search ..... 242/55.3, 129.5, 129.6, 242/129.62, 55, 86.52; 191/12.2 R; 4/172.12, 172.14, 172; 403/171

[56] References Cited

U.S. PATENT DOCUMENTS

| | | | |
|---|---|---|---|
| 1,485,587 | 3/1924 | Best | 242/55 |
| 3,091,414 | 5/1963 | Patnaude | 242/86.52 |
| 3,273,171 | 9/1966 | Lamb | 4/172 |
| 3,514,135 | 5/1970 | Cooper | 403/171 |
| 3,840,713 | 10/1974 | Carpentier | 191/12.2 R |
| 3,920,194 | 11/1975 | Parsen | 242/85 |
| 4,090,798 | 5/1978 | Barton | 403/171 |
| 4,102,529 | 7/1978 | Neblung et al. | 256/70 |
| 4,195,370 | 4/1980 | Budd | 4/172.14 |

FOREIGN PATENT DOCUMENTS

| | | |
|---|---|---|
| 471470 | 3/1974 | Australia . |
| 2508258 | 9/1976 | Fed. Rep. of Germany . |
| 2440855 | 11/1976 | Fed. Rep. of Germany . |
| 609658 | 11/1948 | United Kingdom . |

*Primary Examiner*—Leonard D. Christian
*Attorney, Agent, or Firm*—Channing L. Pace

[57] ABSTRACT

A cover system for an outdoor swimming pool including a light-weight cover member, a composite reel member on which the cover is wound as it is removed from a covering position overlying a swimming pool to a storage condition and a pair of supporting stands to each of which one end of the reel member is journaled. The reel itself is composed of at least two tubular end sections each of which has on one end a hub member having an axle which is received in a bearing carried by each stand. The other ends are connected in abutting relation by internal expanding members disposed within the adjacent ends of the tubular members. One or more intermediate sections may be connected between the end sections by similar internal expanding members. Each stand includes a tubular member bent to substantially inverted U-shape to provide a handle member and having divergent terminals which provide two legs. A third leg is provided by a separate angled tubular member attached to the U-shaped member at the portion from which one leg diverges.

10 Claims, 10 Drawing Figures

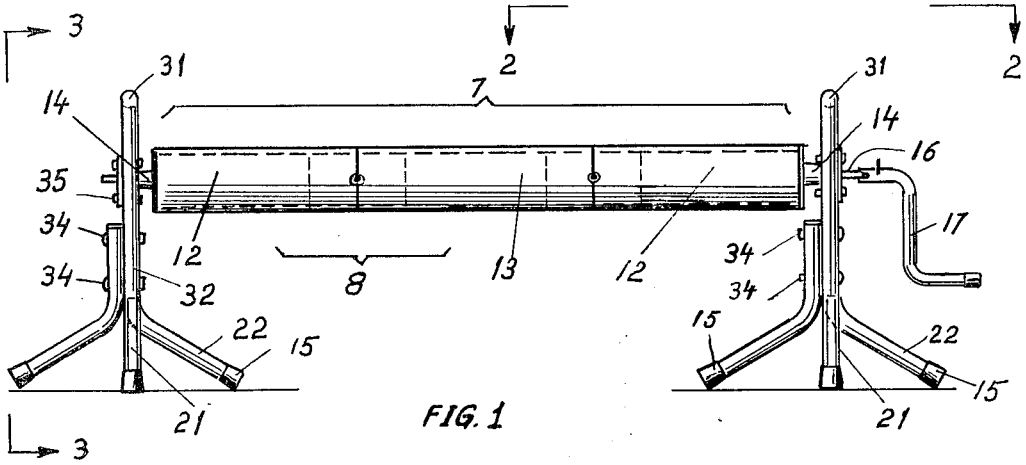
FIG. 1
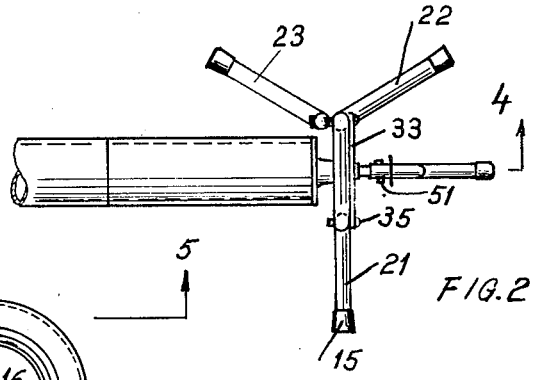
FIG. 2
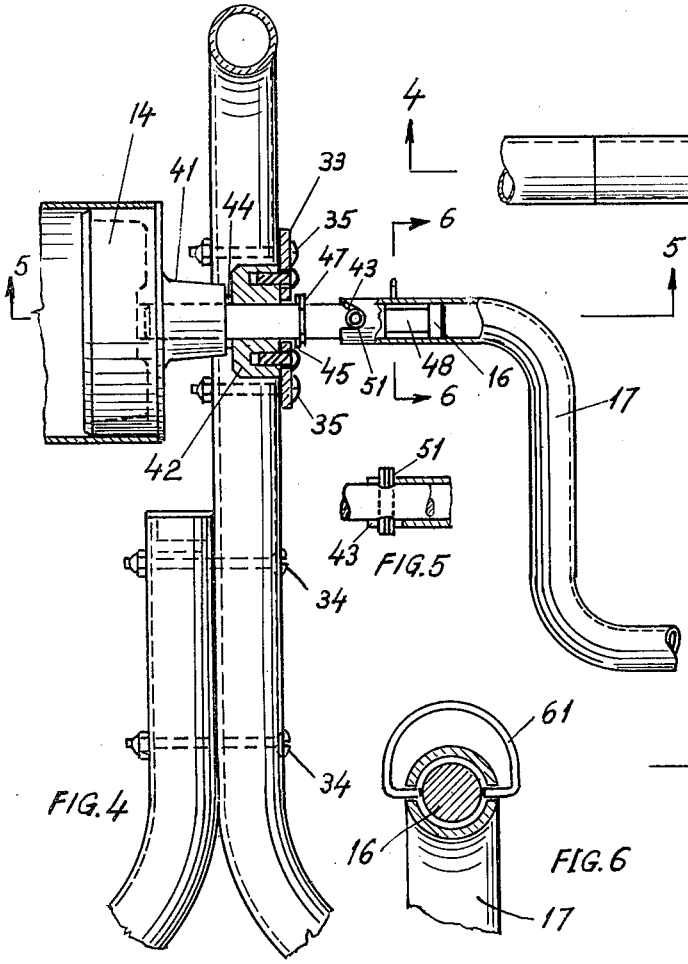
FIG. 4
FIG. 5
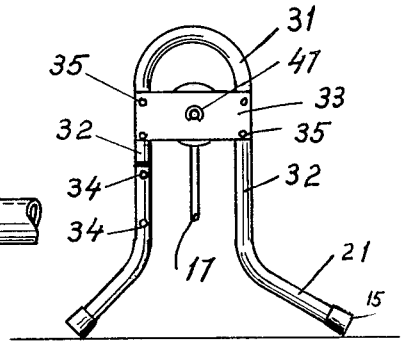
FIG. 3
FIG. 6

COMPOSITE REEL AND STAND FOR A SWIMMING POOL COVER

BACKGROUND OF THE INVENTION

The prior art presents several examples of covers for outdoor swimming pools for the purpose of excluding undesired foreign matter such as falling leaves and otherplant materials or many forms of wind-borne dust and debris from falling into the pool and contaminating the water in the pool. Some of these prior art devices include some form of reel member on which the pool cover is wound when not in use to cover a pool. Several of these reel members are provided with support means which include wheels on which the cover and reel are transported to a storage position adjacent the pool. Some of these supports include motor means to move the support and the cover and reel between pool-covering and pool-uncovering positions.

SUMMARY OF THE INVENTION

The cover, reel and stands of the instant invention are designed to provide a light-weight structure which can be easily manipulated by two persons, even children, on opposite sides of an outdoor pool. The handle portion of each stand makes transporting of the assembly by two persons a very easy matter. Under some circumstances the cover, reel and stands can be carried by grasping the central portion of the reel.

The reel is made up of a plurality of light-weight tubular members. Two of these members are designated as terminal members. Each of these is a hollow, tubular member into one end of which is inserted a hub member which includes a plug member having a centrally disposed shaft extending axially outwardly therefrom to provide an axle for the reel. The other end of each terminal member is open. One or more intermediate tubular members are positioned between the open ends of the terminal members and are connected thereto by expansion members which are inserted into the open ends of the terminal members and also into the adjacent open ends of an intermediate member. The adjacent ends of the terminal and intermediate members are then moved into abutting relationship with the expansion member extending an equal amount into each open end. The expansion member is then expanded by means of a diametrically disposed threaded member to grip the interior of the adjacent open ends.

The stands are identical. Each is made of two pieces of light-weight tubular stock material. The first piece is bent into a U-shaped structure to form a bight portion intermediate the ends of the piece which provides a handle for the stand when completed. The ends of the U-shaped member are bent into a divergent angular relationship with the main portion of the member, the first in the plane of the U-member and the second in a plane at a 60° angle to said plane, to provide two of the three legs of the stand. The second piece is bent at an angle corresponding to the divergent angle of the second leg and is attached, as by through bolts, to the main portion of the stand in the region from which the second leg diverges from the said main portion to provide the third leg of the stand. This third leg is attached to the U-shaped member at an angle of sixty degrees to the plane of the main portion of the U-shaped member and on the side opposite the second leg. Thus the stand is provided with three divergent legs which contact a supporting surface at widely spaced points to provide an extremely stable posture for the stand.

The stand is further provided with a rectangular plate member which spans the distance between the straight portions of the U-member and is attached, as by through bolts, to these straight portions at a convenient location spaced from the transverse or bight portion of the U-member. This plate member not only serves as a brace or reinforcing means for the U-member but also provides support for the bearing member which supports the axle of the reel.

The expansion member is a tubular structure of right circular cylindrical configuration. It is formed by extrusion to provide a one-piece, longitudinally split sleeve having internally a pair of hollow tunnel members extending longitudinally along the adjacent edges of the split and a reinforcing rib extending longitudinally along the interior wall of the sleeve in an area diametrically opposite to the split. The walls of the tunnel members which face each other diverge from adjacent the edge of the split toward the center of the sleeve to form a tunnel having divergently disposed walls. A short, tubular member is positioned within this tunnel and a threaded bolt having a hexagonal head extends from the outside of the sleeve diametrically through the slot in the sleeve, through a transverse threaded bore in the short tubular member and is journaled in a socket formed in the reinforcing rib. Thus, when the bolt is rotated, the short tubular member is forced deeper into the tunnel and the sleeve is expanded diametrically as the split widens.

The cover is made of synthetic plastic material which allows solar heat to penetrate into the water in the pool so that the temperature of the water in the pool can be raised between 10° to 15° F. This feature is of particular value during cooler periods of the season so that the swimming season can be extended. The cover further serves the useful purpose of reducing chemical loss up to 50% and of conserving water by reducing evaporation. The cover also serves to perform the obvious function of keeping the pool cleaner by excluding undesired foreign matter from falling into the pool.

The cover is attached to and readily detachable from the reel member by the use of well-known connecting strips manufactured under the trade name "VELCRO". Thus, any desired number of "VELCRO" strips may be attached to the outer surface of the assembled reel structure at spaced intervals along its length and a corresponding number of companion "VELCRO" strips may be attached to a transverse edge of the cover. The cover or strips which on the other end are attached to the cover may then be attached to the reel structure by pressing the corresponding "VELCRO" strips into contact with each other.

The main object of the present invention is to provide a composite reel and stand assembly for a swimming pool cover which may be shipped in partially assembled condition in such a fashion that the final assembly may be conveniently completed by a dealer or ultimate consumer. Another object of the invention is to provide a reel and stand assembly for supporting a swimming pool cover or any other fabric of considerable width in stored condition. It is another object of the invention to provide a reel and stand assembly for supporting a swimming pool cover in stored condition in which stored condition the assembly with the cover wound on the reel may be easily transported by one or two persons to a point adjacent to one end of a swimming pool so that the cover may be conveniently unwound or withdrawn from the reel to cover the pool. It is a further object of the invention to provide a composite reel for a swimming pool cover, which reel is composed of a plurality of tubular sections including two terminal sections each having one end open and the other end closed by a plug member having a shaft extending axially outwardly therefrom to provide an axle for the reel. At least one intermediate tubular member or sleeve is positioned between the two terminal sections. A further object of this invention is to provide an expandible tubular connector which can be inserted into adjacent open ends of a tubular terminal member and a tubular intermediate member or two tubular intermediate members and, after the respective adjacent ends are brought into abutting engagement, expanded to join the adjacent ends firmly together.

Another object of this invention is to provide an expandible tubular member in the form of a split tubular sleeve member which can be expanded by the operation of a diametrically disposed threaded bolt which is accessible from outside the tubular sleeve.

A still further object of the instant invention is to provide a stand for each end of a reel assembly, the stand being fabricated from tubular stock material bent into U-shape to provide a pair of parallel members connected by an intermediate transverse bight portion which forms a handle for transporting the stand.

Another object of the invention is to provide a stand formed of tubular stock material bent to U-shape to form two parallel portions the ends of which are further bent to provide divergent leg portions. It is another object of the invention to provide a third leg for the stand which is a separate tubular member bent to angular form and attached to the main portion of the stand adjacent the point at which one leg diverges for the main portion.

These together with other objects and advantages which will become subsequently apparent reside in the details of construction and operation as more fully hereinafter described and claimed, reference being had to the accompanying drawings forming a part hereof, wherein like numerals refer to like parts throughout the description.

DETAILED DESCRIPTION OF THE DRAWINGS

FIG. 1 is a side elevational view of the reel and supporting stand showing the leg arrangement of the stands and the connection of the reel to the stands;

FIG. 2 is a partial top plan when viewed on line 2—2 of FIG. 1 showing a profile of the U-shaped stands;

FIG. 3 is an end elevational view taken on line 3—3 of FIG. 1 showing a profile of the stands when viewed from a side;

FIG. 4 is a detailed sectional view taken on line 4—4 of FIG. 2 and showing the relationship of the reel, the hub, the shaft, the bearing carried by the stand and a crank connected to the end of the shaft for operating the reel;

FIG. 5 is a detailed view taken on line 5—5 of FIG. 6 to show clearly the crank-shaft connection when engaged;

FIG. 6 is a sectional view taken on line 6—6 of FIG. 4 showing the shaft, crank and retaining ring assembly which permits the crank to move axially and yet to be an integrated part of the reel;

DETAILED DESCRIPTION OF THE INVENTION

Figure 7:
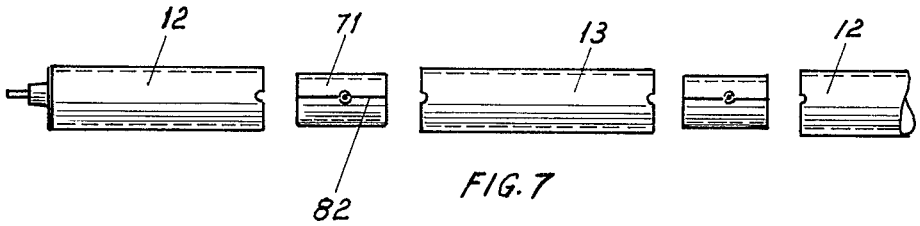
FIG. 7 is an exploded elevational view showing the elements of the reel in disassembled condition.

Referring now more specifically to the drawings the numeral 7 seen in FIG. 1 refers to the composite reel member. This member is composed of two terminal sections 12 and one or more intermediate sections 13. Each of these sections is a length of standard metal pipe having a minimum O. D. of four inches. The length of each section can be six (6) or eight (8) feet, depending on the ultimate length of the completed reel and the required number of sections to produce this length.

Each of the terminal sections as seen in FIG. 4 has a plug 14 inserted in one open end and secured therein. This plug 14 has an enlarged central portion or hub 41 which is bored out to receive a shaft 16. The shaft 16 projects axially beyond the end of the hub 41 to form an axle for the reel. The end of the terminal section from which the shaft 16 projects thus becomes the outer end of the terminal section.

Figure 8:
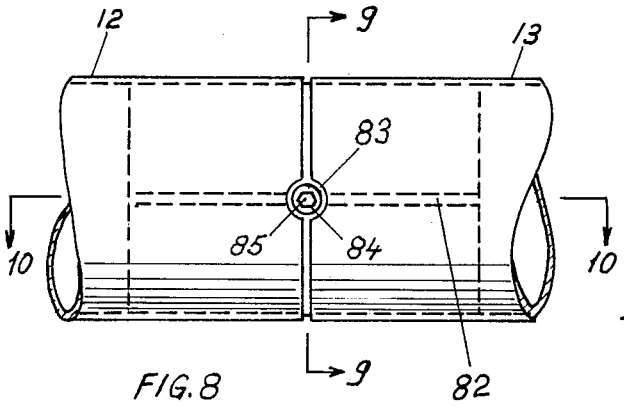
FIG. 8 is a part elevational view showing in dotted lines an expansible member positioned within adjacent ends of two reel sections.
Figure 9:
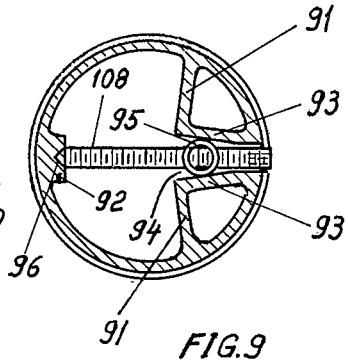
FIG. 9 is a sectional view taken on line 9—9 of FIG. 8.
Figure 10:
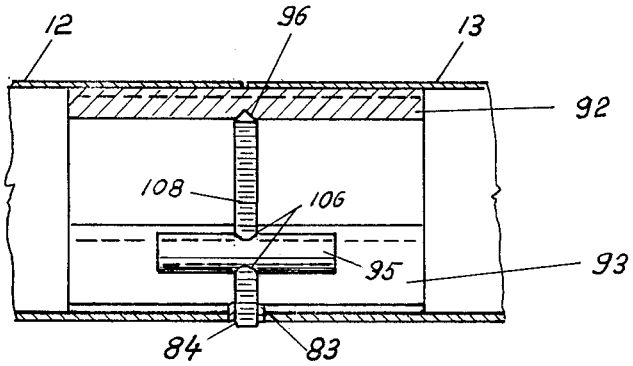
FIG. 10 is a longitudinal sectional view taken on line 10—10 of FIG. 8.

The other end of the terminal section is connected to one end of an intermediate section 13. This connection is effected through the use of the expanding tubular sleeve 71 seen in FIGS. 7, 8, 9 and 10. This sleeve is approximately eight (8) inches in length and is formed as a right circular cylindrical structure having a longitudinal slot 82 extending through its wall from one end to the other. Internally the sleeve has integrally formed tunnel members 91 extending from one end of the sleeve to the other adjacent the slot 82 and an integral longitudinal rib 92 opposite the slot. The walls 93 of these tunnel members which face each other diverge from the slot toward the interior of the sleeve to form a trough 94. A short hollow tubular member 95 having an O. D. equal to the width of the trough at its widest dimension is positioned in this widest portion. Tubular member 95 is bored diametrically and tapped at 106 to receive a threaded bolt 108 which passes through the slot 82 and the tapped bore in tubular member 95 and engages a socket 96 formed in longitudinal rib 92. The slot 82 is formed with an enlarged, circular opening 83 to accommodate a head 84 on the outer end of threaded bolt 108. The head 84 has a hexagonal socket 85 to receive an Allen wrench used to actuate the threaded bolt 108.

The connecting sleeve 71 is inserted into the open end of a terminal member 12 to a depth corresponding to half its length. The other half length of the connecting sleeve 71 which now projects from the inner end of terminal member 12 is then inserted into an open end of intermediate member 13. When the connecting sleeve has been inserted an equal amount into the terminal and connecting members, respectively, the adjacent edges of these members abut. The adjacent end edges of these members are provided with semi-circular notches having a diameter equal to the diameter of the enlarged, circular opening 83 formed in slot 82 of connecting sleeve 71. Thus, when the adjacent ends of the two sections are properly abutted, the two semi-circular notches co-operate to form an opening which gives access to the enlarged opening in the slot 82 and the head 84. A tool such as an Allen wrench can then be used to turn threaded bolt 108 to draw short tubular member 95 down into trough 94 to expand the sleeve member 93 and secure the two abutted ends of the two tubular sections firmly together. If desired, this connection can be made permanent by the application of a band of epoxy cement approximately three (3) inches wide circumferentially around the central portion of the connecting sleeve 71, before inserting the sleeve into the adjacent ends of the tubular sections. Once the epoxy cement has completely cured or set, the two sections are firmly and permanently bonded together.

One or more additional intermediate sections 13 can be attached to the other end of the first intermediate section in the same manner, or the second terminal section can be similarly connected to the first intermediate section, depending upon the desired total length of the reel.

Turning now to the stand, we see in FIGS. 1 and 3 that the stand consists primarily of two pieces of light-weight tubular stock. The first piece is bent into U-shape to form a bight portion 31 and two parallel portions 32. The end portions of the parallel portions are each further bent into an angular relationship with the parallel portions to form legs 21 and 22. One of these legs, designated as the first leg 21, is in the same plane as the U-shaped portion and the other leg, designated as the second leg 22, lies in a plane at a sixty degree angle to this plane. The second piece of light-weight tubular stock is bent at an angle corresponding to the angle of the second leg to form a third leg 23, and this leg is attached to the U-shaped member adjacent the portion at which the second leg is bent out of the plane of the U-shaped member. The attachment is made by through-bolts 34 which pass through portions of the third leg and the parallel portion of the U-shaped member adjacent the portion from which the second leg is bent.

The first leg of the stand is preferable longer and this longer leg can be positioned to face the pool so as to add stability to the stand as the cover, not shown on the drawing, is pulled off the pool, or vice versa. The end of each leg is provided with a cushioning tip 15.

A rectangular plate 33 is attached to each stand adjacent the bight or handle portion 31 and spans the space between the two parallel portions 32. This plate 33 is attached to the parallel portions by through bolts 35.

Plate 33 has two functions. First, it serves as a reinforcement which adds rigidity to the stand. Second, it provides support for a bearing member 42. This bearing is attached to the inboard side of plate 33 in the space between the parallel portions of the U-shaped members which plate 33 spans. This bearing has a bore which receives an axle shaft 16. The shaft 16 extends outwardly beyond the bearing and has a transverse pin 51 which engages a one-way tapered slot 43 in the end of a removable crank member 17 which is used to turn the reel in a direction to wind the cover on the reel. A nylon bearing washer 44 is placed on shaft 16 between hub 41 and bearing 42. Another nylon bearing washer 45 is placed on the shaft 16 outside of plate 33 and is held thereon by a retaining ring 47.

Retaining ring 61 has the function of securing the crank on the shaft at the reduced O. D. portion of the shaft 16 at the end 48. When the reel is rotated by unreeling the cover, by virtue of gravity the crank is disengaged from the pin 51, slipping axially of its previous position.

It can thus be seen that I have provided a reel and stand structure for handling a swimming pool cover wherein both the reel and the stand can be manufactured and shipped in partially assembled form in such manner that they can be finally and completely assembled by a dealer or ultimate consumer. The reel is formed of a plurality of light-weight members of predetermined short lengths joined together by a novel expandible connecting sleeve device which provide great flexibility of choice in selecting the ultimate length of the reel to accommodate any desired width of swimming pool cover. The stand is made of light-weight components and includes a handle portion by means of which, when a stand is attached to each end of a reel having a swimming pool cover wound thereon, the complete assembly can be easily transported by two persons each carrying one end of the reel by the handle of the stand on that end. Indeed, especially in shorter assemblies, the assembly can be carried by one person grasping the central portion of the reel with the cover wound thereon. With the stands and reel assembly positioned adjacent one end of a swimming pool, the cover can easily be pulled off the reel into covering relation with the pool. The position and arrangement of the legs of the stands render the stands extremely stable during this procedure. When it is desired to remove the cover from the pool, this can be done simply by turning crank 17 and the cover will be wound up on reel 7. The cover, reel and stand assembly may then be left in its position adjacent the end of the pool or it can be easily transported to any desired storage area.

Having thus fully described my invention and the manner in which its objects may be carried out, what I claim as new and desire to secure by letters patent is as follows:

1. A reel and stand assembly for a swimming pool cover including:

(a) A composite reel comprising:
- (1) a first hollow tubular member having open ends,
- (2) a hub member secured in one of said open ends and having an axle shaft projecting therefrom,
- (3) a second hollow tubular member having open ends,
- (4) an expansible sleeve member positioned partially in each of adjacent open ends of the first and second hollow tubular members having their ends abutted and
- (5) means accessible through the walls of said abutted ends to expand the expansible sleeve member and secure said first and second hollow tubular members together, (b) a stand comprising:
- (1) a U-shaped member having
  - (a) a bight portion connecting
  - (b) two parallel portions having their ends bent angularly with respect to the parallel portions to provide first and second legs for the stand and
- (2) a plate member spanning the space between the two parallel portions and having a bearing member adapted to receive and support said axle shaft.

2. A device as set forth in claim 1 wherein the hub member includes:

(a) A plug member comprising a disc-like portion having a thickened central portion, (b) an axial bore through said thickened central portion and (c) an axle shaft secured in said bore and projecting therefrom.

3. A device as set forth in claim 1 wherein the hub member includes:

(a) a plug member comprising a disc-like portion having (1) a peripheral skirt portion and (2) a thickened central portion, (b) an axial bore through said thickened central portion and (c) an axle shaft secured in said bore and projecting therefrom.

4. A device as set forth in claim 1 wherein the hub member includes:

(a) a plug member comprising a disc-like portion having (1) a peripheral skirt portion telescoped within and secured to said one open end and (2) a thickened central portion, (b) an axial bore through said thickened central portion and (c) an axle shaft secured in said bore and projecting therefrom.

5. A device as set forth in claim 1 wherein said second hollow tubular member having open ends has a hub member secured in the other of said open ends with an axle shaft projecting therefrom to constitute a reel member having an axle shaft projecting from each end thereof.

6. A device as set forth in claim 5 wherein a third or intermediate hollow tubular member is positioned between the first and second hollow tubular members and an expansible sleeve member is positioned partially in each of the adjacent open ends of the first and intermediate hollow tubular members and of the second and intermediate hollow tubular members to provide a three-piece reel having an axle shaft projecting from each end.

7. A device as set forth in claim 1 wherein the stand further comprises:

(1) (c) one of the legs being bent at a sixty-degree angle to the plane of the U-shaped member and (d) a third angular leg attached to the U-shaped member in the region thereof from which said one of the legs is bent out of the plane of said U-shaped member and extending at an angle of sixty degrees to said plane on the side opposite said one of the legs.

8. A device as set forth in claim 7 wherein one of said first mentioned legs lies in the plane of the U-shaped member and projects farther away from said U-shaped member than the other two legs.

9. A coupling member comprising an expansible sleeve adapted to be inserted into abutted open ends of first and second hollow tubular members and means accessible through the walls of said abutted ends to expand the expansible sleeve and secure said first and second hollow tubular members together, said expansible sleeve comprising a longitudinally split cylinder having internal cam surfaces disposed on opposite sides of the split and said means to expand said sleeve comprising a screw member passing between the cam surfaces and carrying a tapped tubular member.

10. A stand comprising (1) a U-shaped member having (a) a bight portion connecting (b) two parallel portions having their ends bent angularly with respect to the parallel portions to provide first and second legs for the stand, (2) a plate member spanning the space between the two parallel portions and having a bearing member adapted to receive and support an axle shaft and (3) a third leg attached to the U-shaped member at an angle to the plane thereof.

* * * * *